US008419811B2

(12) United States Patent
Schweiger et al.

(10) Patent No.: US 8,419,811 B2
(45) Date of Patent: Apr. 16, 2013

(54) FUEL COMPOSITION

(75) Inventors: Stefan Schweiger, Esslingen (DE); Christina Wedel, Bietigheim-Bissingen (DE); Konrad Ehmann, Remshalden (DE); Holger Lochmann, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 666 days.

(21) Appl. No.: 12/178,666

(22) Filed: Jul. 24, 2008

(65) Prior Publication Data

US 2009/0277078 A1 Nov. 12, 2009

(30) Foreign Application Priority Data

Jul. 28, 2007 (DE) ..... 10 2007 035 500

(51) Int. Cl.
*C10L 1/185* (2006.01)
*C10L 1/18* (2006.01)
*C10L 1/182* (2006.01)

(52) U.S. Cl.
USPC ..... 44/449; 44/436; 44/451

(58) Field of Classification Search ..... 44/320, 44/449, 436, 451
See application file for complete search history.

(56) References Cited

U.S. PATENT DOCUMENTS

2005/0044778 A1* 3/2005 Orr ..... 44/320
2006/0131209 A1 6/2006 Timken

FOREIGN PATENT DOCUMENTS

FR 1415911 A 10/1965
GB 465459 8/1935
GB 1293085 A 10/1972

* cited by examiner

*Primary Examiner* — James Goloboy
*Assistant Examiner* — Chantel Graham
(74) *Attorney, Agent, or Firm* — Gudrun E. Huckett

(57) ABSTRACT

A fuel composition contains at least 74% by volume of C4 to C14 isoalkanes and, pursuant to the determination of the distillation characteristics according to DIN EN ISO 3405, at least 25% by volume of the fuel composition evaporate at temperatures above 110° C. The fuel composition can also contain oxygen-containing organic compounds, aromatic compounds, olefins, and naphthenes.

24 Claims, 2 Drawing Sheets

FUEL COMPOSITION

BACKGROUND OF THE INVENTION

The invention concerns a fuel composition comprising at least 75% by volume C4 to C14 isoalkanes.

GB 465,459 discloses a fuel composition that is comprised exclusively of alkanes. Fuels that are comprised primarily of alkanes are used, for example, in forestry. Regular gasoline contains, in addition to alkanes, considerable proportions of aromatic compounds, oxygenates, olefins, and naphthenes. Further components can be contained also. Fuels that are comprised primarily or completely of alkanes cause in operation in an internal combustion engine a deterioration in the acceleration behavior in comparison to regular gasoline. Disadvantages are observed also for decelerating from is full load, the so-called "rich come down".

It is an object of the invention to provide a fuel composition of the aforementioned kind with which an excellent acceleration behavior and an excellent rich come down behavior of an internal combustion engine is achieved.

SUMMARY OF THE INVENTION

This object is solved by a fuel composition that is characterized in that, when determining the distillation characteristics according to DIN EN ISO 3405, at least 25% by volume of the fuel composition evaporate at temperatures (T) above 110° C.

Known fuel compositions with a high alkane contents have a boiling point curve that deviates from that of regular gasoline. Starting at approximately 100° C., the boiling point curve of known fuel compositions with high alkane proportion extends very flat because these fuels usually have an isooctane proportion of more than 70%. On the other hand, the boiling point curve of regular gasoline continues to ascend above 100° C. Below 100° C. the boiling point curve of fuels with high alkane proportion is however steeper than the boiling point curve of regular gasoline.

It has been found that with a suitable adjustment of the boiling point curve of fuel compositions with high alkane proportions to the boiling point curve of regular gasoline the operating behavior of an internal combustion engine operated with this fuel composition can be significantly improved.

In order to achieve in particular for deceleration of the internal combustion engine from full load, i.e., for rich come down, an improved operating behavior, it is provided that at least 25% by volume of the fuel composition evaporate at temperatures above 110° C. In this connection, the distillation characteristics according to DIN EN ISO 3405 is determined. The distillation characteristics should reach the indicated value within the limits of the measuring precision that is achievable with the method set forth. This temperature that is higher in comparison to known fuel compositions with high alkane proportions is closer to the temperature for regular gasoline. In this way, an improved operating behavior can be achieved.

In particular, at least 30% by volume of the fuel composition evaporate at temperatures above 110° C. All parameters in regard to evaporation of the fuel composition relate in this connection to the determination of the distillation characteristics according to DIN EN ISO 3405.

Advantageously, at least 20% by volume of the fuel composition evaporate at temperatures above 130° C., in particular at least at 140° C. Expediently, at least 10% by volume of the fuel composition evaporate at temperatures above 165° C. In known fuel compositions with high alkane proportion, no, or hardly any, components are contained that boil above 165° C. By designing the boiling point curve in such a way that at least 10% by volume of the fuel composition evaporate at temperatures above 165° C., the operating behavior of the internal combustion engine can be significantly improved.

In order to improve the acceleration behavior of an internal combustion engine operated with the fuel composition it is provided that at least 20% by volume of the fuel composition evaporate at temperatures below 70° C., in particular at temperatures below 65° C. Expediently, at least 30% by volume of the fuel composition evaporate at temperatures below 85° C.

In order to enable, for example, the use of the fuel composition also in forestry, it is provided that the alkane proportion of the fuel composition is more than 85% by volume. Advantageously, the fuel composition comprises up to approximately 97% by volume of C4 to C14 isoalkanes.

For adjusting the boiling point curve, it is provided that the fuel composition contains approximately 7% by volume up to approximately 57% by volume, in particular approximately 12% by volume up to approximately 45% by volume, expediently approximately 18% by volume up to approximately 30% by volume, advantageously approximately 25% by volume, of C10 to C14 alkanes. For a proportion of approximately 7% by volume up to approximately 57% by volume of C10 to C14 alkanes, in particular isoalkanes, the rich come down behavior is improved in comparison to known fuels with high isoalkane proportion. In addition, an improved acceleration and starting behavior can be achieved in particular for a C10 to C14 alkane proportion of approximately 18% by volume up to approximately 30% by volume. C10 to C14 alkanes are alkanes with 10 to 14 carbon atoms. For adjustment of the boiling point curve in the lower range it is provided that the fuel composition contains approximately 10% by volume up to approximately 40% by volume, expediently approximately 13% by volume up to approximately 30% by volume, advantageously approximately 15% by volume up to approximately 25% by volume, especially preferred approximately 20% by volume, of C4 to C5 isoalkanes. C4 and C5 alkanes are alkanes with four or five carbon atoms, i.e., butane and pentane. In comparison to known fuel compositions with high alkane proportion the proportion of C4 and C5 alkanes is increased. In this way, a greater proportion of the fuel composition already evaporates at lower temperatures. In this way, an improved starting behavior and acceleration behavior can be achieved. For a C4 and C5 alkane proportion of approximately 15% by volume up to approximately 25% by volume, the acceleration behavior and starting behavior can be further improved.

It is provided to reduce the proportion of C6 to C9 alkanes in favor of higher boiling C10 to C14 alkanes and in favor of lower boiling C4 and C5 alkanes. Advantageously, the fuel composition contains no more than 60% by volume C6 to C9 alkanes. C6 to C9 alkanes are alkanes with 6 to 9 carbon atoms, i.e., hexanes, heptanes, octanes, and nonanes. Advantageously, the fuel composition contains approximately 30% by volume up to approximately 60% by volume, in particular approximately 40% by volume to approximately 55% by volume of C6 to C9 alkanes. For a C6 to C9 alkane proportion an excellent rich come down behavior results, and for a C6 to C9 alkanes proportion of approximately 40% by volume up to 55% by volume the acceleration and starting behaviors are also further improved. The C6 to C9 alkanes are advantageously isoalkanes.

It can be advantageous that the fuel composition contains up to approximately 20% by volume of oxygen-containing organic compounds. In this way, the proportion of biogenic substances, i.e., the substances of biologic or organic origin in the fuel composition, can be up to approximately 20% by volume. Expediently, the proportion of oxygen-containing organic compounds is up to approximately 10% by volume, in particular up to approximately 6% by volume. For a proportion of oxygen-containing organic compounds of up to approximately 6% by volume, a comparatively minimal leaning results for the fuel/air mixture generated in operation of an internal combustion engine from the fuel composition and the combustion air. At the same time, the octane rating of the fuel composition increases by means of the proportion of oxygen-containing organic components. For a proportion of oxygen-containing organic components of approximately 6% by volume up to approximately 10% by volume the octane rating increases further. At the same time, the fuel/air mixture is becoming more lean. This leads to an increased operating temperature of the internal combustion engine so that for an increase of the proportion of oxygen-containing organic components suitable measures must be taken in order to avoid an operating temperature of the internal combustion engine that is too high.

In this connection, the oxygen-containing organic compounds can be methanol, ethanol, ethyl tertiary-butyl ether (ETBE), methyl tertiary-butyl ether (MTBE), and/or butanol. It is provided that the proportion of C6 to C9 alkanes is reduced in favor of oxygen-containing organic compounds. The proportion of C6 to C9 alkanes and of the oxygen-containing organic compounds in the fuel composition together is advantageously approximately 30% by volume up to 60% by volume, in particular approximately 40% by volume up to approximately 55% by volume.

In order to avoid autoignition of the fuel in operation, it is provided that the fuel composition has an engine octane rating of more than 87, in particular of more than 90. It is provided that the fuel composition is suitable for a two-stroke engine or for a mixture-lubricated four-stroke engine. Advantageously, the fuel composition contains a two-stroke engine oil for lubricating the two-stroke engine or mixture-lubricated four-stroke engine. The proportion of the two-stroke engine oil is advantageously less than approximately 5% by volume, expediently approximately 1% by volume up to approximately 3% by volume, in particular approximately 2% by volume, of the fuel composition.

Advantageously, the fuel composition comprises aromatic compounds wherein the proportion of aromatic compounds is advantageously less than approximately 5% by volume, in particular less than approximately 1% by volume. It is provided that the fuel composition contains benzene wherein the proportion of benzene in the fuel composition is advantageously less than approximately 0.2% by volume, in particular less than approximately 0.1% by volume. Expediently, the fuel composition contains olefins wherein less than approximately 5% by volume, in particular less than approximately 1% by volume, of olefins are contained in the fuel composition. It is provided that the fuel composition contains naphthenes wherein advantageously less than approximately 5% by volume, in particular less than approximately 1% by volume, of naphthenes are contained.

DESCRIPTION OF PREFERRED EMBODIMENTS

Figure 1:
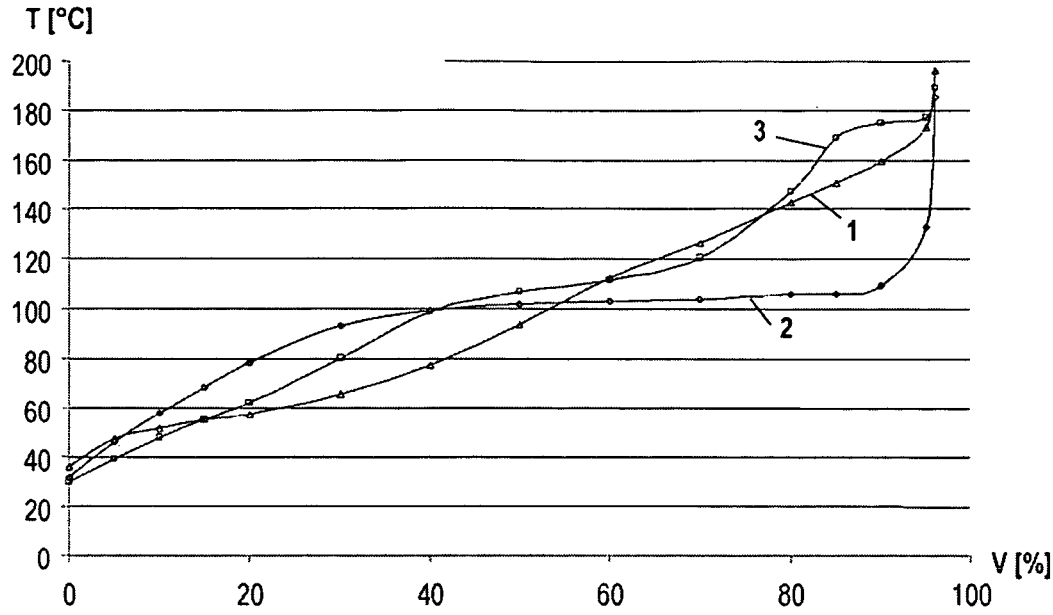
FIG. 1 shows a diagram that illustrates the boiling point curve of different fuel compositions.

In FIG. 1, the boiling point curve of different fuel compositions is shown. The temperature T in ° C. is plotted against the fuel proportion in % by volume evaporated at this temperature. The boiling point curve is measured and plotted in accordance with DIN EN ISO 3405. Curve 1 shows the boiling point curve of regular gasoline. The boiling point curve ascends comparatively constantly. Components are contained that evaporate above 180° C. The curve 2 shows the boiling point curve for conventional specialty fuel that has a high proportion of alkanes. The boiling point curve of this fuel extends below 100° C. more steeply than the boiling point curve of regular gasoline and has then a very flat course. Curve 3 shows an exemplary boiling point curve for the new fuel composition. The course of the boiling point curve is approximated to the course of the boiling point curve of regular gasoline. Up to approximately 100° C., the course of the boiling point curve is more flat than the course of the curve 2 of conventional specialty fuel, i.e., fuel that has a high isoalkane proportion and that is used e.g. in forestry. The adjoining course of the boiling point curve is significantly steeper than for conventional specialty fuel. The new fuel composition comprises also higher-boiling components.

The boiling point curve of the new fuel composition is adjusted such that at least 25% by volume, in particular at least 30% by volume, of the fuel composition evaporate at temperatures T above 110° C. The point of the boiling point curve where approximately 70% by volume of a sample has evaporated is at approximately 116° C. to approximately 125° C. At least 20% by volume of the fuel composition evaporate at temperatures T above 130° C. in particular at least at 140° C. The point of the boiling point curve at which 80% by volume of a sample have evaporated is at approximately 140° C. to approximately 152° C. 10% by volume of the fuel composition evaporate at temperatures T above 165° C. The point of the boiling point curve at which 90% by volume of a sample have evaporated, is approximately at 168° C. to approximately 178° C. The end of boiling is at approximately 200° C. in the low boiling range it is provided that at least 20% by volume of the fuel composition T evaporate at temperatures T below approximately 70° C., in particular temperatures T below 65° C. The point of the boiling point curve at which 20% by volume of the sample have evaporated is at approximately 59° C. to approximately 68° C. The point of the boiling point curve at which 30% by volume of the sample have evaporated is at approximately 65° C. to approximately 85° C.

In order to reach this course of the boiling point curve, the proportion of C10 to C14 alkanes is increased at the expense of the proportion of C6 to C9. Moreover, the proportion of C4 and C5 alkanes is increased at the expense of C6 to C9. An advantageous fuel composition that has a boiling point curve in accordance with curve 3 contains approximately 5% by volume of C4 alkanes, approximately 20% by volume of C5 alkanes, approximately 48% by volume of C8 alkanes, approximately 6% by volume of C11 alkanes, and approximately 17% by volume C12 alkanes. In more detail, the fuel can comprise approximately 4.8% by volume of n-butane, approximately 19.7% by volume of 2-methyl butane, approximately 32.5% by volume 2,2,4-trimethyl pentane, approximately 1% by volume 2,2-dimethyl hexane, approximately 1.5% by volume of 2,2,3-trimethyl pentane, approximately 1.4% by volume of 2,4-dimethyl hexane, approximately 6.2% by volume of 2,3,4-trimethyl pentane, approximately 3.3% by volume of 2,3,3-trimethyl pentane, approximately 15% by volume of 2,3-dimethyl hexane, approximately 17.2% by volume of C12 isoparafins as well as a total of approximately 6% by volume of different isomers of C11 isoparafins, and approximately 2% by volume two-stroke engine oil. Further components whose proportion in the fuel composition is less than 1% by volume are not listed in detail. The proportion of aromatic compounds, olefins, and naphthenes is less than 1% by volume, respectively. The proportion of benzene is less than 0.1% by volume. In this connection, a proportion of 0.5% by volume of aromatic compounds and 0.05% by volume of benzene can be provided. The proportion of olefins can be approximately 0.2% by volume and the proportion of naphthenes can be approximately 0.1% by volume. In this first fuel composition no oxygen-containing organic compounds are contained.

A second fuel composition that contains oxygen-containing organic compounds can have the following composition: 4% by volume of n-butane 1.1% by volume of 2-methyl butane, 38.8% by volume of 2,2,4-trimethyl pentane, 7.1% by volume of 2,3,4-trimethyl pentane, 5.2% by volume of 2,3,3-rmethyl pentane, 18.2% by volume of C12 isoparafins, and 5.5% by volume of ethanol.

A third fuel composition contains also additional oxygen-containing organic compounds, The proportion of C6 to C9 alkanes is accordingly reduced. The third fuel composition contains 23.1% by volume of 2-methyl butane, 51.3% by volume of 2,2,4-trimethyl pentane, 18.1% by volume of C12 isoparafins, 5.5% by volume of ethanol, and 2% by volume of methyl tertiary-butyl ether (MTBE).

A fourth fuel composition that contains no oxygen-containing organic compounds can comprise 29.9% by volume of 2-methyl butane, 57.3% by volume of 2,2,4-trimethyl pentane, 3.0% by volume of isoundecane, 6.2% by volume of isododecane, as well as 3.6% by volume of p-xylene.

A fifth fuel composition contains 11.2% by volume of 2-methyl butane, 30.2% by volume of 2,2,4-trimethyl pentane, 45% by volume of isodecane, 2.0% by volume of two-stroke engine oil, for example, HP Super of the Stihl company, 2.5% by volume of ethanol, 2.0% by volume MTBE, 4.8% by volume of p-xylene, and 2.3% by volume of cyclopentane.

Figure 2:
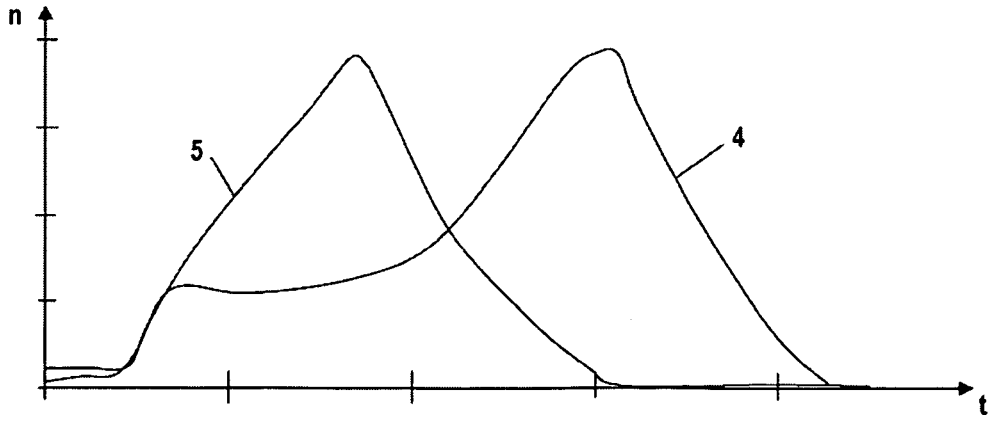
FIG. 2 shows the acceleration behavior of an internal combustion engine with a conventional fuel composition and with a fuel composition according to the invention.

The illustration of FIG. 2 shows the acceleration behavior of a proposed new fuel composition with adjusted boiling point curve in comparison to a conventional specially fuel with high alkane proportion. In this connection, the engine speed n is plotted against the time t. Curve 4 shows the acceleration behavior of conventional specially fuel. As can be taken from the illustration, the engine speed n does not increase uniformly but increases first to a plateau, from where the engine speed n first increases slowly to a maximum engine speed. For the new fuel composition illustrated by curve 5 a uniform acceleration up to the maximum engine speed is achieved. The maximum engine speed is reached earlier than for conventional specialty fuel.

Figure 3:
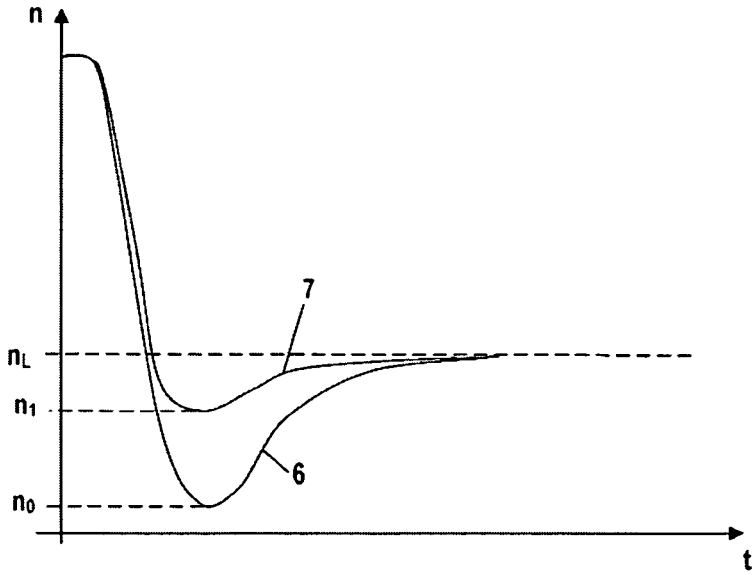
FIG. 3 shows the rich come down behavior of an internal combustion engine with a conventional fuel composition and with a fuel composition according to the invention.

For the deceleration process when the throttle in the intake passage of the internal combustion engine is suddenly closed, i.e., the so-called rich come down, a strong enrichment of the fuel/air mixture in the internal combustion engine occurs. This causes a very strong drop in engine speed. For the new fuel composition the engine speed drop is less pronounced as for conventional specialty fuel. This is illustrated in FIG. 3. Here, the engine speed n is plotted against time t. The engine speed course for the conventional specialty fuel is illustrated by curve 6. Upon sudden closure of the throttle, the engine speed n drops sharply to a minimal engine speed $n_o$ that is far below the idle speed $n_L$. Subsequently, the engine speed n increases to the idle speed $n_L$. The engine speed course for the new fuel composition is illustrated by curve 7. Both curves 6 and 7 show only the general course of the engine speed n. With the new fuel composition the engine speed drop is less pronounced. The engine speed n drops to a minimal engine speed $n_1$ that is also below the idle speed $n_L$ but the engine speed $n_1$ is significantly above the engine speed $n_o$. Overshooting of the engine speed course is significantly attenuated by the new fuel composition. After reaching the minimal engine speed $n_1$, the engine speed n increases with the new fuel composition also to the idle speed $n_L$.

The increased proportion of low-boiling components such as C4 and C5 alkanes improves also the starting behavior of the engine so that an improved operating behavior results.

All disclosed fuel composition have advantageously an engine octane rating that is greater than 87, in particular greater than 90.

What is claimed is:

1. Fuel composition for a two-stroke engine or a mixture-lubricated four-stroke engine, the fuel composition containing less than approximately 5% by volume of a two-stroke engine oil and having an engine octane rating of more than 87, wherein the fuel composition contains more than 85% by volume alkanes, wherein the alkanes comprise at least 75% by volume of C4 to C14 isoalkanes, wherein the fuel composition is suitable for use in forestry and contains less than approximately 5% by volume of aromatic compounds, less than approximately 0.2% by volume of benzene, and less than approximately 5% by volume of olefins;

wherein, pursuant to the determination of the distillation characteristics according to DIN EN ISO 3405, at least 25% by volume of the fuel composition evaporate at temperatures above 110° C., wherein the fuel composition contains 13% by volume to 30% by volume C4 to C5 isoalkanes;

wherein of the at least 25% by volume of the fuel composition that evaporate at temperatures above 110° C., a portion that is at least 20% by volume of the total fuel composition evaporates at temperatures above 130° C.;

wherein, of the at least 25% by volume of the fuel composition that evaporate at temperatures above 110° C., a portion that is at least 10% by volume of the total fuel composition evaporates at temperatures above 165° C.

2. Fuel composition according to claim 1, wherein at least 30% by volume of the fuel composition evaporate at temperatures above 110° C.

3. Fuel composition according to claim 1, wherein at least 20% by volume of the fuel composition evaporate at temperatures of at least 140° C.

4. Fuel composition according to claim 1, wherein at least 20% by volume of the fuel composition evaporate at temperatures below 70° C.

5. Fuel composition according to claim 1, wherein at least 20% by volume of the fuel composition evaporate at temperatures below 65° C.

6. Fuel composition according to claim 1, wherein at least 30% by volume of the fuel composition evaporate at temperatures below 85° C.

7. Fuel composition according to claim 1, wherein the alkanes comprise up to approximately 97% by volume of C4 to C14 isoalkanes.

8. Fuel composition for a two-stroke engine or a mixture-lubricated four-stroke engine, the fuel composition containing less than approximately 5% by volume of a two-stroke engine oil and having an engine octane rating of more than 87, wherein the fuel composition contains more than 85% by volume alkanes, wherein the alkanes comprise at least 75% by volume of C4 to C14 isoalkanes, wherein the fuel composition is suitable for use in forestry and contains less than approximately 5% by volume of aromatic compounds, less than approximately 0.2% by volume of benzene, and less than approximately 5% by volume of olefins;

wherein, pursuant to the determination of the distillation characteristics according to DIN EN ISO 3405, at least 25% by volume of the fuel composition evaporate at temperatures above 110° C., wherein the fuel composition contains approximately 18% by volume up to approximately 30% by volume of C10 to C14 alkanes;

wherein of the at least 25% by volume of the fuel composition that evaporate at temperatures above 110° C., a portion that is at least 20% by volume of the total fuel composition evaporates at temperatures above 130° C.;

wherein, of the at least 25% by volume of the fuel composition that evaporate at temperatures above 110° C., a portion that is at least 10% by volume of the total fuel composition evaporates at temperatures above 165° C.

9. Fuel composition according to claim 8, wherein the fuel composition contains approximately 25% by volume of C10 to C14 alkanes.

10. Fuel composition according to claim 1, wherein the fuel composition contains approximately 15% by volume up to approximately 25% by volume of C4 to C5 isoalkanes.

11. Fuel composition for a two-stroke engine or a mixture-lubricated four-stroke engine, the fuel composition containing less than approximately 5% by volume of a two-stroke engine oil and having an engine octane rating of more than 87, wherein the fuel composition contains more than 85% by volume alkanes, wherein the alkanes comprise at least 75% by volume of C4 to C14 isoalkanes, wherein the fuel composition is suitable for use in forestry and contains less than approximately 5% by volume of aromatic compounds, less than approximately 0.2% by volume of benzene, and less than approximately 5% by volume of olefins;

wherein, pursuant to the determination of the distillation characteristics according to DIN EN ISO 3405, at least 25% by volume of the fuel composition evaporate at temperatures above 110° C., wherein the fuel composition contains no more than 60% by volume of C6 to C9 alkanes;

wherein of the at least 25% by volume of the fuel composition that evaporate at temperatures above 110° C., a portion that is at least 20% by volume of the total fuel composition evaporates at temperatures above 130° C.;

wherein, of the at least 25% by volume of the fuel composition that evaporate at temperatures above 110° C., a portion that is at least 10% by volume of the total fuel composition evaporates at temperatures above 165° C.

12. Fuel composition according to claim 11, wherein the fuel composition contains approximately 30% by volume up to approximately 60% by volume of C6 to C9 alkanes.

13. Fuel composition according to claim 1, wherein the fuel composition contains up to approximately 20% by volume of at least one oxygen-containing organic compound.

14. Fuel composition according to claim 13, wherein the at least one oxygen-containing organic compound is selected from the group consisting of methanol, ethanol, ethyl tertiary-butyl ether (ETBE), methyl tertiary-butyl ether (MTBE), and butanol.

15. Fuel composition according to claim 13, wherein the proportion of C6 to C9 alkanes and of the at least one oxygen-containing organic compound in the fuel composition together is approximately 30% by volume up to approximately 60% by volume.

16. Fuel composition according to claim 1, wherein the fuel composition has an engine octane rating of more than 90.

17. Fuel composition according to claim 1, wherein the proportion of the two-stroke engine oil in the fuel composition is approximately 2% by volume.

18. Fuel composition according to claim 1, wherein the fuel composition contains less than approximately 1% by volume of aromatic compounds.

19. Fuel composition according to claim 1, wherein the fuel composition contains less than approximately 0.1% by volume of benzene.

20. Fuel composition according to claim 1, wherein the fuel composition contains less than approximately 1% by volume of olefins.

21. Fuel composition according to claim 1, wherein the fuel composition contains naphthenes.

22. Fuel composition according to claim 21, wherein the fuel composition contains less than approximately 5% by volume of naphthenes.

23. Fuel composition according to claim 22, wherein the fuel composition contains less than approximately 1% by volume of naphthenes.

24. Fuel composition for a two-stroke engine or a mixture-lubricated four-stroke engine, the fuel composition containing less than approximately 5% by volume of a two-stroke engine oil and having an engine octane rating of more than 87, wherein the fuel composition contains more than 85% by volume alkanes including C4 to C14 isoalkanes;

wherein the fuel composition is suitable for use in forestry and contains less than approximately 5% by volume of aromatic compounds, less than approximately 0.2% by volume of benzene, and less than approximately 5% by volume of olefins;

wherein, pursuant to the determination of the distillation characteristics according to DIN EN ISO 3405, at least 25% by volume of the fuel composition evaporate at temperatures above 110° C.;

wherein, of the more than 85% by volume alkanes of the fuel composition, a proportion of 13% by volume to 30% by volume of the total fuel composition are C4 to C5 isoalkanes;

wherein, of the more than 85% by volume alkanes of the fuel composition, a proportion of approximately 18% by volume up to approximately 30% by volume of the total fuel composition are C10 to C14 alkanes;

wherein, of the more than 85% by volume alkanes of the fuel composition, a proportion of no more than 60% by volume of the total fuel composition are C6 to C9 alkanes;

wherein of the at least 25% by volume of the fuel composition that evaporate at temperatures above 110° C., a portion that is at least 20% by volume of the total fuel composition evaporates at temperatures above 130° C.;

wherein, of the at least 25% by volume of the fuel composition that evaporate at temperatures above 110° C., a portion that is at least 10% by volume of the total fuel composition evaporates at temperatures above 165° C.

* * * * *